US009418801B2

(12) United States Patent
Huang

(10) Patent No.: US 9,418,801 B2
(45) Date of Patent: Aug. 16, 2016

(54) LIGHT-INDUCED LUMINOUS KEYBOARD

(71) Applicant: Xiuhai Huang, Shenzhen (CN)

(72) Inventor: Xiuhai Huang, Shenzhen (CN)

( * ) Notice: Subject to any disclaimer, the term of this patent is extended or adjusted under 35 U.S.C. 154(b) by 167 days.

(21) Appl. No.: 14/075,058

(22) Filed: Nov. 8, 2013

(65) Prior Publication Data

US 2014/0132159 A1 May 15, 2014

(30) Foreign Application Priority Data

Nov. 13, 2012 (CN) ..... 2012 2 0595399 U

(51) Int. Cl.
*H01H 13/83* (2006.01)

(52) U.S. Cl.
CPC ..... *H01H 13/83* (2013.01); *H01H 2219/038* (2013.01)

(58) Field of Classification Search
CPC ... H01H 2219/03; H01H 2219/038–2219/039; H01H 13/83; H01H 13/02; H01H 13/023; H01H 13/70; H01H 13/403; H01H 13/702; H01H 2203/052; H01H 11/00; H05B 37/02; H05B 33/0872; H05B 33/0854; G02B 6/0011; F21V 8/00
USPC ..... 315/149, 292, 316; 200/313–314, 317; 250/208.1, 208.2, 208.4, 208.6, 250/214 PR; 362/23.01, 23.02, 23.03; 345/168, 169, 170
See application file for complete search history.

(56) References Cited

U.S. PATENT DOCUMENTS

| | | | | |
|---|---|---|---|---|
| 4,112,443 A * | 9/1978 | Iguchi | G03B 7/083 396/233 |
| 6,175,196 B1 * | 1/2001 | Ragner et al. | 315/200 A |
| 2012/0012448 A1 * | 1/2012 | Pance et al. | 200/314 |

* cited by examiner

*Primary Examiner* — Jimmy Vu
*Assistant Examiner* — Henry Luong
(74) *Attorney, Agent, or Firm* — Ballard Spahr LLP

(57) ABSTRACT

A light-induced luminous keyboard includes a keyboard main part, a power supply, and a first circuit, a second circuit and a third circuit parallel to each other. The above circuits include two transistors and a negative coefficient photoresistor. While being played in a decreasing light intensity environment, the light-induced luminous keyboard has an increased resistance of a negative coefficient photoresistor and thus an increased voltage is divided for the negative coefficient photoresistor, the point that the base of the first transistor is connected with the first circuit is in a high level, thus the first transistor is available, the point that the base of the second transistor is connected with the second circuit is drawn down to zero volt, the second transistor is available, the luminous apparatus is turned on and the keyboard illuminates. Therefore, automatic illumination of the keyboard is implemented dependent on environmental light intensity.

12 Claims, 4 Drawing Sheets

LIGHT-INDUCED LUMINOUS KEYBOARD

This application claims the benefit of priority to Chinese patent application No. 201220595399.9 titled "LIGHT-INDUCED LUMINOUS KEYBOARD" and filed with the Chinese State Intellectual Property Office on Nov. 13, 2012, the entire disclosure of which is incorporated herein by reference.

TECHNICAL FIELD

The present application relates to the technical field of luminous keyboard, and in particular to a light-induced luminous keyboard.

BACKGROUND

Keyboard is the most common computer input device and is widely used in microcomputer and all kinds of terminal devices. A computer operator inputs various instructions and data into a computer via a keyboard to instruct the computer to run. The running condition of the computer is outputted to a displayer, and the operator may conveniently interact with the computer, modify and edit procedure, and control and observe the running of the computer by the keyboard and displayer.

As an important input device, the use of the keyboard will be influenced in a dark condition, and the operator is unable to see the letters on the keys or related instruction keys. Therefore, a luminous device is provided in the keyboard, which is mainly used in a weak light intensity situation such as backlight. Various marketable backlight keyboards are controlled in a manner of manual key-press. The backlight keyboards are of a continuous illumination (illuminating at any time), a manual key-press illumination or a touch illumination. Such manual control may result in resource waste and strong mechanicalness, i.e., strong reliance on human operation. It is impossible to illuminate automatically based on environmental light intensity.

Thus, those skilled in the art are studying how to provide a light-induced luminous keyboard to realize an automatic illumination dependent on environmental light intensity.

SUMMARY

An embodiment of the disclosure provides a light-induced luminous keyboard to realize automatic illumination dependent on environmental light intensity.

A light-induced luminous keyboard, including a keyboard main part; a first circuit, a second circuit and a third circuit parallel to each other, which are connected and communicated with the power supply; wherein the first circuit includes a first resistor connected with the power supply and a negative coefficient photoresistor in series with the first resistor; the second circuit includes a second resistor and a first transistor in series with the second resistor, wherein the second resistor is connected with the collector of the first transistor, and the base of the first transistor is connected with the first circuit with a connection point between the first resistor and the negative coefficient photoresistor; the third circuit includes a second transistor and a luminous apparatus in series with the second transistor, wherein the second transistor has an emitter connected with the power supply and a base connected with the second circuit with a connection point between the collector of the first transistor and the second resistor, and the luminous apparatus is connected with the collector of the second transistor.

The luminous apparatus may be an LED light.

The light-induced luminous keyboard may further include a third resistor in series with the luminous apparatus.

The light-induced luminous keyboard may further include a fourth circuit paralleled with the light-induced luminous keyboard, wherein the fourth circuit includes a third transistor which has an emitter connected with the power supply, a collector connected with the third circuit with a connection point between the luminous apparatus and the collector of the second transistor, and a base connected with a manual switch.

A fourth resistance may be in series with the base of the third transistor.

The third circuit may further include a fourth transistor, which has an emitter connected with the power supply, a collector connected with the emitter of the second transistor, and a base connected with a manual switch.

A fifth resistor may be in series with the base of the fourth transistor.

The manual switch may be a transistor.

The manual switch may be a key on the keyboard main part.

The negative coefficient photoresistor may be provided at the sunny side (or in other words, the front side) of the keyboard main part.

The light-induced luminous keyboard provided in the disclosure, including a keyboard main part; a first circuit, a second circuit and a third circuit parallel to each other, which are connected and communicated with the power supply; wherein the first circuit includes a first resistor connected with the power supply and a negative coefficient photoresistor in series with the first resistor; the second circuit includes a second resistor and a first transistor in series with the second resistor, wherein the second resistor is connected with the collector of the first transistor, and the base of the first transistor is connected with the first circuit with a connection point between the first resistor and the negative coefficient photoresistor; the third circuit includes a second transistor and a luminous apparatus in series with the second transistor, wherein the second transistor has an emitter connected with the power supply and a base connected with the second circuit with a connection point between the collector of the first transistor and the second resistor, and the luminous apparatus is connected with the collector of the second transistor. While being played in an increasing environmental light intensity, the light-induced luminous keyboard has a decreased resistance of a negative coefficient photoresistor and thus a decreased voltage is divided for the negative coefficient photoresistor, and the point that the base of a first transistor is connected with a first circuit is in a low level, thus the first transistor is unavailable, so that the point that the base of a second transistor is connected with a second circuit is in a high level and the second transistor is unavailable. Therefore, the luminous apparatus is disconnected and the keyboard does not illuminate.

While being played in a decreasing light intensity environment, the light-induced luminous keyboard has an increased resistance of a negative coefficient photoresistor and thus an increased voltage is divided for the negative coefficient photoresistor, the point that the base of the first transistor is connected with the first circuit is in a high level, thus the first transistor is available, the point that the base of the second transistor is connected with the second circuit is drawn down to zero volt, the second transistor is available, the luminous apparatus is turned on and the keyboard illuminates.

In conclusion, the light-induced luminous keyboard according to an embodiment of the disclosure can illuminate automatically dependent on environmental light intensity.

BRIEF DESCRIPTION OF THE DRAWINGS

In order to more clearly illustrate embodiments of the disclosure or technical solutions in the prior art, drawings are briefly introduced below for illustrating the embodiments or the prior art. Apparently, the drawings are used to illustrate some embodiments of the disclosure, and those skilled in the art may achieve other drawings, based on the following drawings, without any creative work.

DETAILED DESCRIPTION

It is provided a light-induced luminous keyboard according to an embodiment of the disclosure, which can illumination automatically dependent on environmental light intensity.

In order to make the object, technical solutions and advantages of the disclosure more clear, technical solutions in embodiments of the disclosure are described clearly and completely in conjunction with the drawings. Apparently, here described is only a part but not all embodiments of the disclosure. The protection scope of the present application is defined in the claims.

Figure 1:
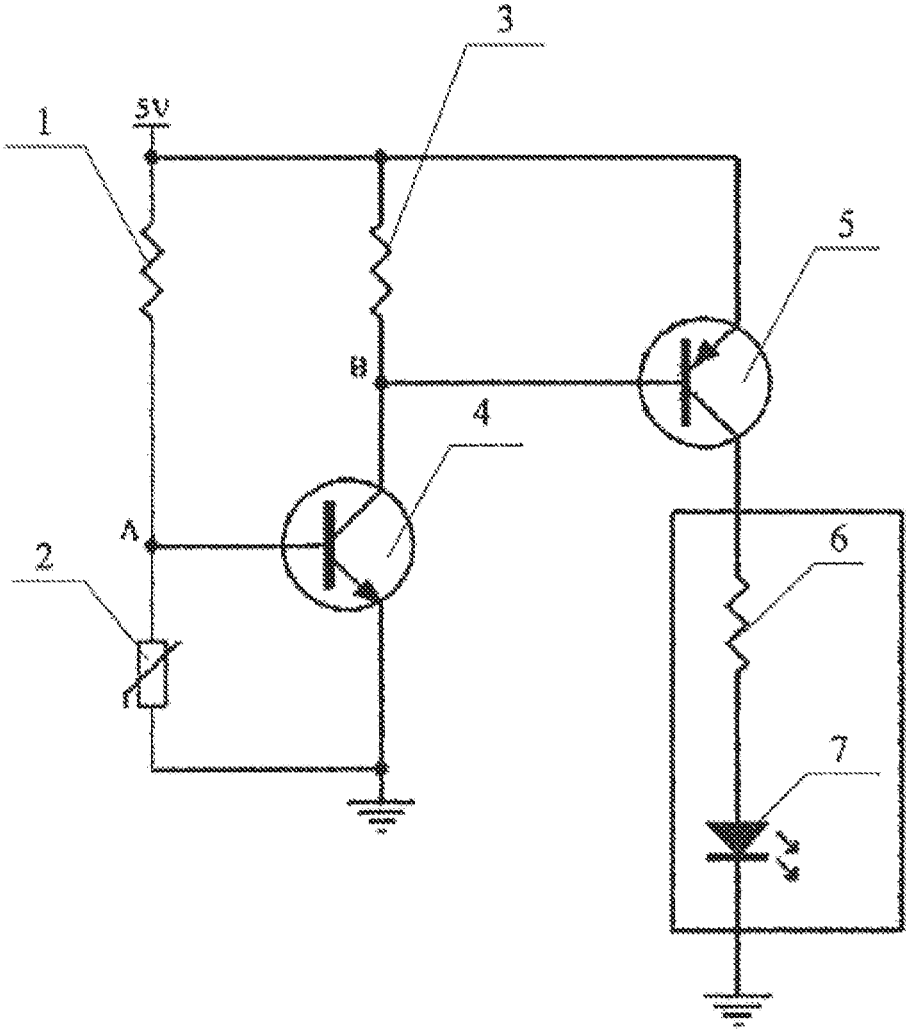
FIG. 1 is a structural diagram of a light-induced luminous keyboard according to an embodiment of the disclosure.
Figure 4:
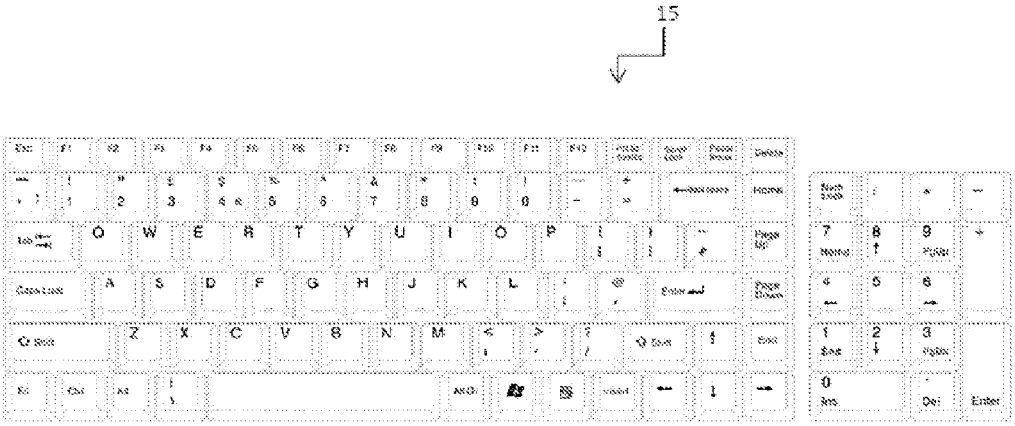
FIG. 4 is an isometric view of a light-induced luminous keyboard according to an embodiment of the disclosure.

Referring now to FIGS. 1 and 4, disclosed herein is a light-induced luminous keyboard 15 according to an embodiment of the disclosure. FIG. 1 is a structural diagram of a light-induced luminous keyboard according to an embodiment of the disclosure. The light-induced luminous keyboard according to the embodiment includes: a keyboard main part, a power supply provided on the keyboard main part, and a first circuit, a second circuit and a third circuit parallel to each other, which are connected and communicated with the power supply. The first circuit includes a first resistor I connected with the power supply and a negative coefficient photoresistor 2 in series with the first resistor 1. The second circuit includes a second resistor 3 and a first transistor 4 in series with the second resistor 3. The second resistor 3 is connected with the collector of the first transistor 4. The base of the first transistor 4 is connected with the first circuit, with the connection point between the first resistor 1 and the negative coefficient photoresistor 2. The third circuit includes a second transistor 5 and a luminous apparatus 7 in series with the second transistor 5. The second transistor 5 has an emitter connected with the power supply a base connected with the second circuit with the connection point between the collector of the first transistor 4 and the second resistor 3, and a collector connected with the luminous apparatus 7. While being played in an increasing environmental light intensity, the light-induced luminous keyboard has a decreased resistance of a negative coefficient photoresistor 2 and thus a decreased voltage is divided for the negative coefficient photoresistor 2, and the point that the base of a first transistor 4 is connected with a first circuit is in a low level, thus the first transistor 4 is unavailable, so that the point that the base of a second transistor 5 is connected with a second circuit is in a high level and the second transistor 5 is unavailable. Therefore, the luminous apparatus 7 is disconnected and the keyboard does not illuminate.

While being played in a decreasing light intensity environment, the light-induced luminous keyboard has an increased resistance of a negative coefficient photoresistor 2 and thus an increased voltage is divided for the negative coefficient photoresistor 2, the point that the base of the first transistor 4 is connected with the first circuit is in a high level, thus the first transistor 4 is available, the point that the base of the second transistor 5 is connected with the second circuit is drawn down to zero volt, the second transistor 5 is available, the luminous apparatus 7 is turned on and the keyboard illuminates.

In conclusion, the light-induced luminous keyboard according to an embodiment of the disclosure can illuminate automatically dependent on environmental light intensity.

The connection mode of the first circuit, the second circuit and the third circuit may be direct grounding.

The light-induced luminous keyboard may be embodied as many kinds of luminous keyboards, such as a common luminous keyboard, a game luminous keyboard, a mechanical luminous keyboard. Alternatively, the light-induced luminous keyboard may be automatic-manner controlled.

In this embodiment, the luminous apparatus 7 is an LED light, which has a long lifetime, a high lighting effect, a low radiation, and a low power consumption, and has a good using effect.

In this embodiment, the above light-induced luminous keyboard further includes a third resistor 6 in series with the luminous apparatus 7. The third resistor 6 function as voltage division, which prevents the luminous apparatus 7 from an over-high voltage and its damage.

Figure 2:
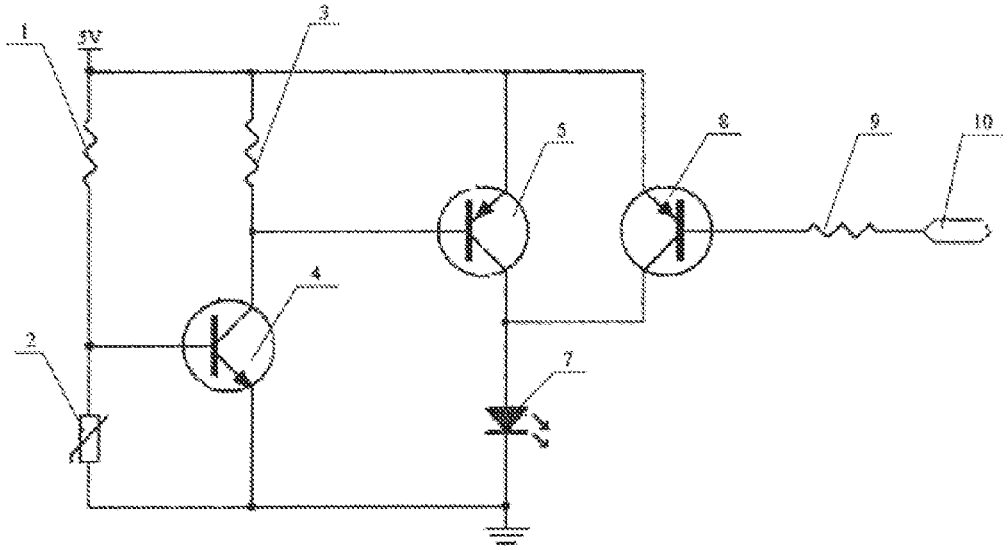
FIG. 2 is a structural diagram of a manual-automatic light-induced luminous keyboard according to a first embodiment of the disclosure.

FIG. 2 is a structural diagram of a manual-automatic light-induced luminous keyboard according to a first embodiment of the disclosure. The above light-induced luminous keyboard further includes a fourth circuit connected with thereof in parallel. The fourth circuit includes a third transistor 8. The third transistor 8 has an emitter connected with the power supply, a collector connected with the third circuit with the connection point between the luminous apparatus 7 and the collector of the second transistor 5, and a base connected with a manual switch 10. A further control manner, i.e., manual control, is introduced for the light-induced luminous keyboard according to the embodiments of the disclosure through the fourth circuit which is in parallel with the first circuit, the second circuit and the third circuit. Therefore, the light-induced luminous keyboard has two control manners: automatic control and manual control.

In this embodiment, a fourth resistor 9 is in series with the base of the third transistor 8. The fourth resistor 9 may function as voltage division, which prevents the third transistor 8 from an over-high voltage and its damage.

Figure 3:
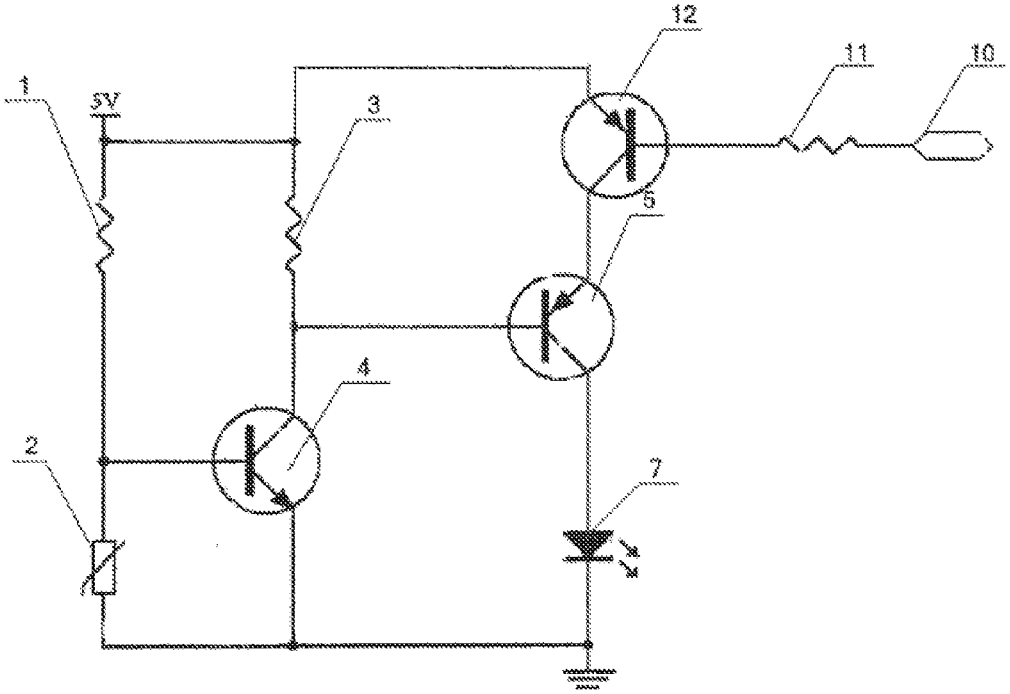
FIG. 3 is a structural diagram of a manual-automatic light-induced luminous keyboard according to a second embodiment of the disclosure, wherein: first resistor 1, negative coefficient photoresistor 2, second resistor 3, first transistor 4, second transistor 5, third resistor 6, luminous apparatus 7, third transistor 8, fourth resistor 9, manual switch 10, fifth resistor 11, fourth transistor 12.

FIG. 3 is a structural diagram of a manual-automatic light-induced luminous keyboard according to a second embodiment of the disclosure. The above third circuit further includes a fourth transistor 12. The fourth transistor 12 has an emitter connected with the power supply, a collector connected with the emitter of the second transistor 5, and a base connected with a manual switch 10. A further control manner, i.e., manual control, is introduced for the light-induced luminous keyboard according to the embodiments of the disclosure through the fourth transistor 12 which is in series with and in parallel with the third circuit and through the manual switch 10 connected with the base of the fourth transistor 12.

Therefore, the light-induced luminous keyboard has two control manners: automatic control and manual control.

In this embodiment, a fifth resistor 11 is in series with the base of the fourth transistor 12. The fifth resistor 11 may function as voltage division, which prevents the fourth transistor 12 from an over-high voltage and its damage.

In this embodiment, the manual switch 10 is a transistor, which may be used as a contactless switch, with advantages of a small volume, a light weight, a high efficiency and a long lifetime and a convenient control.

In this embodiment, the manual switch is a key on the keyboard main part. For manual convenience, the rarely-used Scroll Lock key may be defined as the manual switch.

In this embodiment, the negative coefficient photoresistor is provided at the sunny side (or in other words, the front side) of the keyboard main part, for light induction of the negative coefficient photoresistor. The negative coefficient photoresistor may be provided generally between indicating LEDs of the Caps Lock and the Scroll Lock on the keyboard main part.

Alternatively, the negative coefficient photoresistor may be aligned with the indicating LEDs of the Caps Lock and the Scroll Lock, and are shielded by a light beacon.

The outline of the keyboard main part is not limited to the embodiments of the disclosure.

The foregoing description of the embodiments disclosed enables those skilled in the art to implement or use the disclosure. Various modifications to these embodiments may be apparent to those skilled in the art, and the general principle defined in the disclosure can be implemented in other embodiments without departing from the scope of the disclosure. Therefore, the disclosure is limited to the illustrated embodiments. The scope of the disclosure is defined as the accompanying claims.

What is claimed is:

1. A light-induced luminous keyboard, comprising:

a keyboard main part;

a power supply provided on the keyboard main part; and a first circuit, a second circuit and a third circuit parallel to each other, which are connected and communicated with the power supply;

wherein the first circuit comprises a first resistor connected with the power supply and a negative coefficient photoresistor in series with the first resistor;

the second circuit comprises a second resistor and a first transistor in series with the second resistor, wherein the second resistor is connected with a collector of the first transistor, and a base of the first transistor is connected with the first circuit with a connection point between the first resistor and the negative coefficient photoresistor;

the third circuit comprises a second transistor and a luminous apparatus in series with the second transistor, wherein the second transistor has an emitter connected with the power supply and a base connected with the second circuit with a connection point between the collector of the first transistor and the second resistor, and the luminous apparatus is connected with the collector of the second transistor;

a fourth circuit comprising a third transistor which has an emitter connected with the power supply, a collector connected with the third circuit with a connection point between the luminous apparatus and the collector of the second transistor, and a base connected with a manual switch.

2. The light-induced luminous keyboard according to claim 1, wherein the luminous apparatus is an LED light.

3. The light-induced luminous keyboard according to claim 1, wherein the manual switch is a transistor.

4. The light-induced luminous keyboard according to claim 1, wherein the manual switch is a key on the keyboard main part.

5. The light-induced luminous keyboard according to claim 1, wherein a third resistor is in series with the base of the third transistor.

6. The light-induced luminous keyboard according to claim 1, wherein the negative coefficient photoresistor is provided at a front side of the keyboard main part.

7. A light-induced luminous keyboard comprising:

a keyboard main part;

a power supply provided on the keyboard main part; and a first circuit, a second circuit and a third circuit parallel to each other, which are connected and communicated with the power supply;

wherein the first circuit comprises a first resistor connected with the power supply and a negative coefficient photoresistor in series with the first resistor;

the second circuit comprises a second resistor and a first transistor in series with the second resistor, wherein the second resistor is connected with a collector of the first transistor, and a base of the first transistor is connected with the first circuit with a connection point between the first resistor and the negative coefficient photoresistor;

the third circuit comprises a second transistor and a luminous apparatus in series with the second transistor, wherein the second transistor has an emitter connected with the power supply and a base connected with the second circuit with a connection point between the collector of the first transistor and the second resistor, and the luminous apparatus is connected with the collector of the second transistor;

wherein the third circuit further comprises a third transistor, which has an emitter connected with the power supply, a collector connected with the emitter of the second transistor, and a base connected with a manual switch.

8. The light-induced luminous keyboard according to claim 7, wherein a third resistor is in series with the base of the third transistor.

9. The light-induced luminous keyboard according to claim 7, wherein the manual switch is a transistor.

10. The light-induced luminous keyboard according to claim 7, wherein the manual switch is a key on the keyboard main part.

11. The light-induced luminous keyboard according to claim 7, wherein the luminous apparatus is an LED light.

12. The light-induced luminous keyboard according to claim 7, wherein the negative coefficient photoresistor is provided at a front side of the keyboard main part.

* * * * *